US007626113B2

(12) United States Patent
Kuroda

(10) Patent No.: US 7,626,113 B2
(45) Date of Patent: Dec. 1, 2009

(54) TONE DATA GENERATION METHOD AND TONE SYNTHESIS METHOD, AND APPARATUS THEREFOR

(75) Inventor: Junji Kuroda, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 526 days.

(21) Appl. No.: 11/248,583

(22) Filed: Oct. 11, 2005

(65) Prior Publication Data

US 2006/0081119 A1 Apr. 20, 2006

(30) Foreign Application Priority Data

Oct. 18, 2004 (JP) ..... 2004-303259

(51) Int. Cl.
*G10H 5/02* (2006.01)

(52) U.S. Cl. ..... 84/659; 84/622; 84/623; 84/624; 84/625; 84/647; 84/692

(58) Field of Classification Search ..... 84/622, 84/623, 624, 625, 647, 659, 692
See application file for complete search history.

(56) References Cited

U.S. PATENT DOCUMENTS

| | | | | |
|---|---|---|---|---|
| 5,029,509 | A * | 7/1991 | Serra et al. | 84/625 |
| 5,444,128 | A | 8/1995 | Ichizuka et al. | |
| 5,536,902 | A * | 7/1996 | Serra et al. | 84/623 |
| 5,789,689 | A | 8/1998 | Doidic et al. | |
| 5,792,971 | A | 8/1998 | Timis et al. | |
| 6,362,411 | B1 * | 3/2002 | Suzuki et al. | 84/626 |
| 6,606,388 | B1 * | 8/2003 | Townsend et al. | 381/17 |
| 6,816,833 | B1 * | 11/2004 | Iwamoto et al. | 704/207 |
| 6,836,761 | B1 * | 12/2004 | Kawashima et al. | 704/258 |
| 2003/0177892 | A1 * | 9/2003 | Akazawa et al. | 84/616 |
| 2003/0221542 | A1 * | 12/2003 | Kenmochi et al. | 84/616 |

FOREIGN PATENT DOCUMENTS

| | | |
|---|---|---|
| EP | 0 124 197 A | 11/1984 |
| EP | 0 463 825 A | 1/1992 |
| JP | 200-163058 | 6/2000 |

OTHER PUBLICATIONS

T. Modegi et al., "Proposals of MIDI Coding And Its Application For Audio Authoring", Multimedia Computing and Systems, Proceedings, IEEE International Conference, Jun. 28, 1998, pp. 305-314.

J. Atkin, "Steinberg Recycle Rhythm Loop Editing Software (MacIntosh)", Keyboard, Music Player Network, San Francisco, CA, vol. 20, N o. 9, pp. 129, 131-133, Sep. 1, 1994.

* cited by examiner

*Primary Examiner*—Walter Benson
*Assistant Examiner*—Kawing Chan
(74) *Attorney, Agent, or Firm*—Morrison & Foerster LLP

(57) ABSTRACT

Based on the understanding that time-varying characteristics of a tone element, such as an amplitude and pitch, in waveform data acquired through a live performance of a musical instrument include a variation component intended or controllable by a human player and a variation component not intended or non-controllable by the human player, the present invention allows the two components to be adjusted/controlled separately and independently of each other, so as to achieve effective and high-quality control. Discrete variation value train is acquired for at least one particular tone element in original waveform data, and the acquired variation value train is separated, in accordance with a time constant factor, into a "swell" value train of a relatively great time constant and a "fluctuation" value train of a relatively small time constant. The "swell" value train and "fluctuation" value train are variably controlled independently of each other. In this way, high-quality control can be performed on tone elements, such as an amplitude and pitch, included in the sampled waveform data.

5 Claims, 5 Drawing Sheets

TONE DATA GENERATION METHOD AND TONE SYNTHESIS METHOD, AND APPARATUS THEREFOR

BACKGROUND OF THE INVENTION

The present invention relates to a tone data generation method and apparatus and tone synthesis method and apparatus which can be suitably used in tone generation apparatus, such as electronic musical instruments and automatic performance apparatus, to permit high-quality control of tone elements, such as the amplitude and pitch, included in sampled waveform data.

There have been known so-called samplers which store sampled waveform data of tones in a memory and use the memory-stored waveform data as tone sources of an electronic musical instrument or the like. Where tones are synthesized using the sampled waveform data, it is desirable to freely control/adjust tone elements, such as an amplitude and pitch, when the tones are to be reproduced, rather than simply reproducing the sampled original waveform itself. As a technique designed for such improved tone synthesis, Japanese Patent Application Laid-open Publication No. HEI-5-297866 discloses that, when tone signals are to be sampled and stored in a memory as PCM waveform data, fluctuation (variation) components included in the tone signal are simultaneously detected for the frequency and amplitude and stored into a fluctuation data storage means. When the memory-stored waveform data are to be read out to reproduce the tone signals, the frequency and amplitude fluctuation data are also read out from the fluctuation data storage means, then frequency and amplitude modulations of the read-out waveform data are performed in accordance with the frequency and amplitude fluctuation data, and also the respective depths of these modulations are also controlled. However, the technique disclosed in the No. HEI-5-297866 publication is only arranged to detect, as fluctuation components, frequency and amplitude variation components in the PCM waveform data and perform modulation and control on the detected variation components. Further, Japanese Patent Publication No. HEI-7-82336 discloses detecting a time-varying pitch of each sampled tone signal and storing, into a memory, pitch envelope information indicative of variation over time of the tone pitch on the basis of the detection. In reproducing the tone, a pitch envelope is generated by performing interpolation on the pitch envelope information to appropriately modify the pitch envelope information, and a pitch of the tone to be reproduced is set on the basis of the generated pitch envelope. The technique disclosed in the No. HEI-7-82336 too is only arranged to detect and store variation over time of the tone pitch itself and perform modification/control on the time-varying pitch so that the modified/controlled pitch is used for reproduction of the tone.

The aforementioned conventional techniques can provide high-quality waveform data by sampling a tone performed, for example, on a natural musical instrument, and can also perform, to some extent, control to simulate natural variations of tone elements by detecting and storing, as envelopes, variations over time of tone elements, such as the pitch and amplitude, and then controlling these tone element envelopes at the time of reproduction. However, if envelopes of tone elements, such as a pitch and amplitude, are merely extracted and controlled as taught in the aforementioned conventional techniques, it would be difficult to adjust an expression and degree of humanness of a performed tone. For example, if unison tones or chord tones are polyphonically synthesized using a plurality of waveform data indicative of different characteristics and habits (inclinations) present in pitch and amplitude variations, then pitch intervals between the tones to be synthesized would greatly deviate so that the tones sound like a poor-pitch performance or amplitude expressions of the individual tones undesirably differ from each other. In such a case, the conventional techniques can not make effective adjustments to eliminate the inconveniences. For example, it is conceivable to polyphonically synthesize waveform data of flat characteristics by removing characteristics and habits present in pitch and amplitude variations to convert the pitch and amplitude into flat characteristics; in this case, however, the synthesized tones would become monotonous, losing their individuality as acoustic musical instrument tones.

SUMMARY OF THE INVENTION

In view of the foregoing, it is an object of the present invention to provide a tone data generation method and apparatus and tone synthesis method and apparatus which permit high-quality control of tone elements, such as an amplitude and pitch, included in sampled waveform data. It is another object of the present invention to provide a computer program related to the tone data generation method and tone synthesis method, and a storage medium storing the computer program, as well as a storage medium storing a novel data format of tone synthesizing data and tone synthesizing data prepared in the novel data format.

In order to accomplish the above-mentioned objects, the inventor has come up with the idea that efficient and high-quality control is permitted by extracting at least one component and adjusting/controlling the extracted component, focusing attention on the fact that time-varying characteristics of tone elements, such as an amplitude and pitch, in waveform data obtained through a live performance by a human player include a variation component intended by or controllable by the human player or a variation component not intended by or non-controllable by the human player.

According to an aspect of the present invention, the present invention provides a tone data generation method, which comprises: a first step of acquiring a discrete variation value train (i.e., train of discrete variation values) for at least one particular tone element in original waveform data; and a second step of extracting, from the variation value train, at least one time-serial component value train in accordance with a time constant factor. The variation value train of the particular tone element is expressed using at least the component value train extracted by the second step.

The present invention is characterized by extracting at least one time-serial component value train from the variation value train in accordance with a time constant factor, based on recognition that a variation component intended by or controllable by a human player has a time constant factor (or time-constant-like factor). Thus, it is possible to analyze arithmetically or quantitatively the variation component intended by or controllable by a human player and a variation component not intended by or non-controllable by the human player. As an example, extracting at least one time-serial component value train from the variation value train in accordance with a time constant factor comprises separating the variation value train into two time-serial component trains, depending on the time constant factor, to thereby extract the two time-serial component trains. For example, a variation component of a relatively great time constant may be extracted from the variation value train and generated as a first component value train, while a variation component of a relatively small time constant may be extracted from the variation value train and generated as a second component value train. Typically, the extraction of the variation component of a relatively great time constant may be executed by a process based on a suitable smoothing function, low-pass filter process or the like; in this specification, these processes will be generically called "smoothing". By extracting such a variation component of a relatively great time constant, it is possible to extract a variation component intended by or controllable by the human player. In this specification, a variation component of a relatively great time constant, i.e. a variation component intended by or controllable by the human player, will be referred to as "swell". In an embodiment, the first component value train generated on the basis of the smoothing of the variation value train is a "swell" value train. Variation component of a relatively small time constant, on the other hand, can be considered to correspond to a variation component not intended by or non-controllable by the human player, which can be arithmetically generated as a residual value (or difference), from the variation value train of the first component value train (i.e. "swell" value train). In the embodiment to be explained later, a variation component of a relatively small time constant, i.e. variation component not intended by or non-controllable by a human player, will be referred to as "fluctuation". The second component value train generated on the basis of the difference between the variation value train and the first component value train ("swell" value train) is a "fluctuation" value train.

Namely, according to an embodiment of the present invention, a variation value train of a particular tone element, such as an amplitude or pitch, can be expressed as at least separated first and second component value trains ("swell" and "fluctuation" value trains) of different time constant characteristics. Thus, in performing tone waveform synthesis using these value trains, the present invention can variably adjust/control the first and second component value trains (i.e., "swell" and "fluctuation" value trains) independently of each other, and can thereby perform high-quality control. For example, where unison tones and chord tones are to be polyphonically synthesized using a plurality of (sets) waveform data indicative of different characteristics or habits (inclinations) in pitch and amplitude variations, the first component value train ("swell" value train) corresponding to a variation component intended by or controllable by the human player is variably adjusted as necessary while the second component value train ("fluctuation" value train) corresponding to a variation component not intended by or non-controllable by the human player is not variably controlled substantially, so that well-balanced adjustment can be performed appropriately with ease. Namely, in synthesizing a plurality of tones, the present invention can variably control expressions of the individual tones and degree of uneveness in the fluctuation. Further, in tone synthesis at large, controlling the variation components separated and extracted as "swell" and "fluctuation" in accordance with an embodiment of the present invention can variably control novel (heretofore-nonexistent) tone control parameters, such as degree of expression of a synthesized tone, human fluctuation peculiar to an acoustic musical instrument.

From the viewpoint of tone synthesis, the tone data generation method of the present invention further comprises: a third step of variably controlling at least one component value train in terms of at least one of a value and time axis; a fourth step of generating tone data including the variation value train of the particular tone element on the basis of the component value train variably controlled by the third step.

According to another aspect of the present invention, there is provided a tone synthesis method for synthesizing a tone using a storage section storing at least one component value train extracted, in accordance with a time constant factor, from a variation value train of one particular tone element in original waveform data. The tone synthesis method of the present invention comprises: a first step of performing, in accordance with a desired tone generating time length, expansion or contraction control on a time axis of at least one component value train to be read out from the storage section, to thereby obtain the component value train having a time length corresponding to the desired tone generating time length; a second step of variably controlling a value of at least one such component value train read out from the storage section or having the time axis subjected to the expansion/contraction control by the first step; a third step of generating the variation value train of the particular tone element on the basis of at least one such component value train read out from the storage section or controlled by the first step or the second step; and a fourth step of generating a tone for the tone generating time length, using the variation value train and other tone-element-related data.

The present invention may be constructed and implemented not only as the method invention as discussed above but also as an apparatus invention. Also, the present invention may be arranged and implemented as a software program, for execution by a computer or processor, directed to a procedure having features similar to the aforementioned, as well as a storage medium storing such a software program. Further, the processor used in the present invention may comprise a dedicated processor with dedicated logic built in hardware, not to mention a computer or other general-purpose type processor capable of running a desired software program. Furthermore, the present invention may be implemented as a computer-readable storage medium storing tone synthesizing data of a novel data structure comprising first and second component value trains (i.e., "swell" and "fluctuation" values trains) as set forth above.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

[Data Creation Processing]

First, a description will be given about embodiments of a waveform data generation method, apparatus and program (collectively referred to as "data creation processing") of the present invention, which are intended to generate trains of "swell" values and "fluctuation" values for specific tone elements on the basis of original waveform data.

Figure 1:
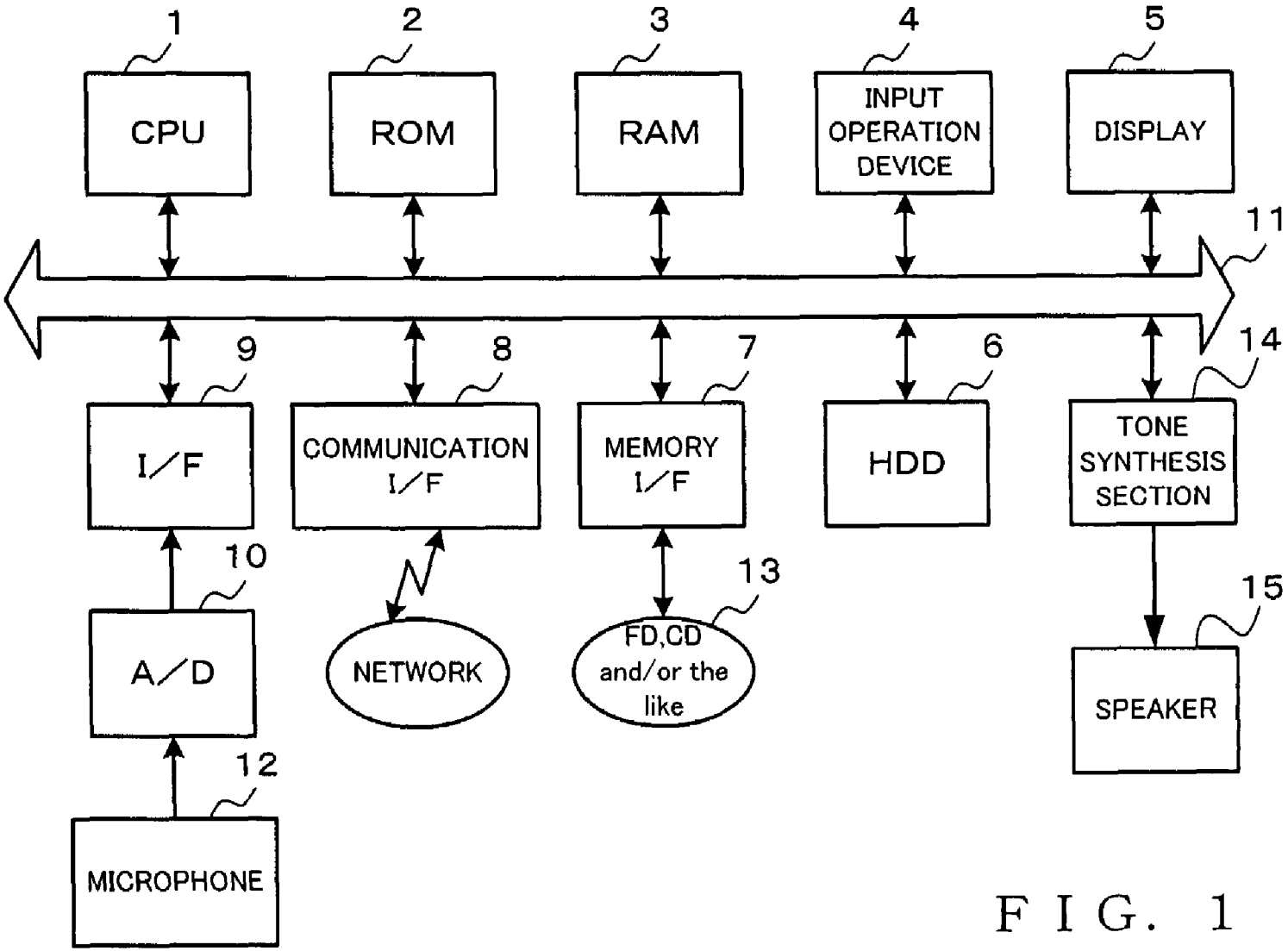
FIG. 1 is a block diagram showing an example of a general setup of a computer to be used for data creation processing according to an embodiment of the present invention.

FIG. 1 is a block diagram showing an example of a general setup of a computer to be used for the data creation processing according to the embodiment of the present invention, which may be of any suitable conventionally-known construction. In the illustrated example, the computer comprises a CPU (Central Processing Unit) 1, a ROM (Read-Only Memory) 2, a RAM (Random Access Memory) 3, an input operation device 4 including a keyboard, mouse and the like, a display 5, a hard disk 6, a memory interface 7 for a removal storage medium, such as a CD (Compact Disk) and FD (Flexible Disk), a communication interface 8 for communicating data with external equipment, a waveform input interface 9 for inputting waveform data, an A/D converter 10, etc.

Figure 2:
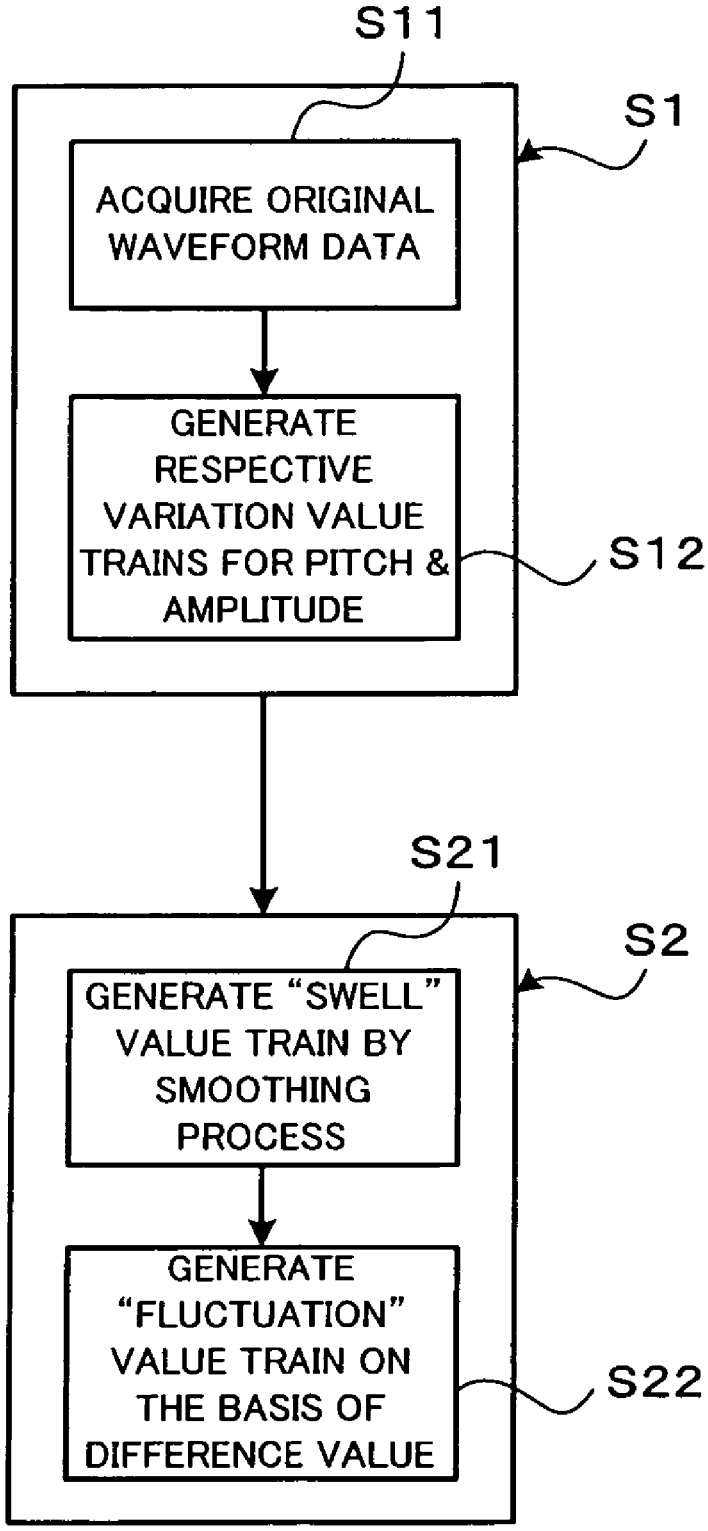
FIG. 2 is a flow chart showing an example operational sequence of the data creation processing according to the embodiment of the present invention.

FIG. 2 is a flow chart showing an example operational sequence of the data creation processing according to the embodiment of the present invention. This processing program, which is prestored in a CD or other storage medium, is installed into the computer of FIG. 1 for execution by the CPU 1.

The data creation processing flowcharted in FIG. 2 generally comprises two major steps S1 and S2. First step S1 is directed to acquiring a train of discrete variation values (i.e., "variation value train") pertaining to at least one tone element in original waveform data. This step S1 may comprise any known operational sequence, a preferred example of which may be arranged as follows.

Figure 3:
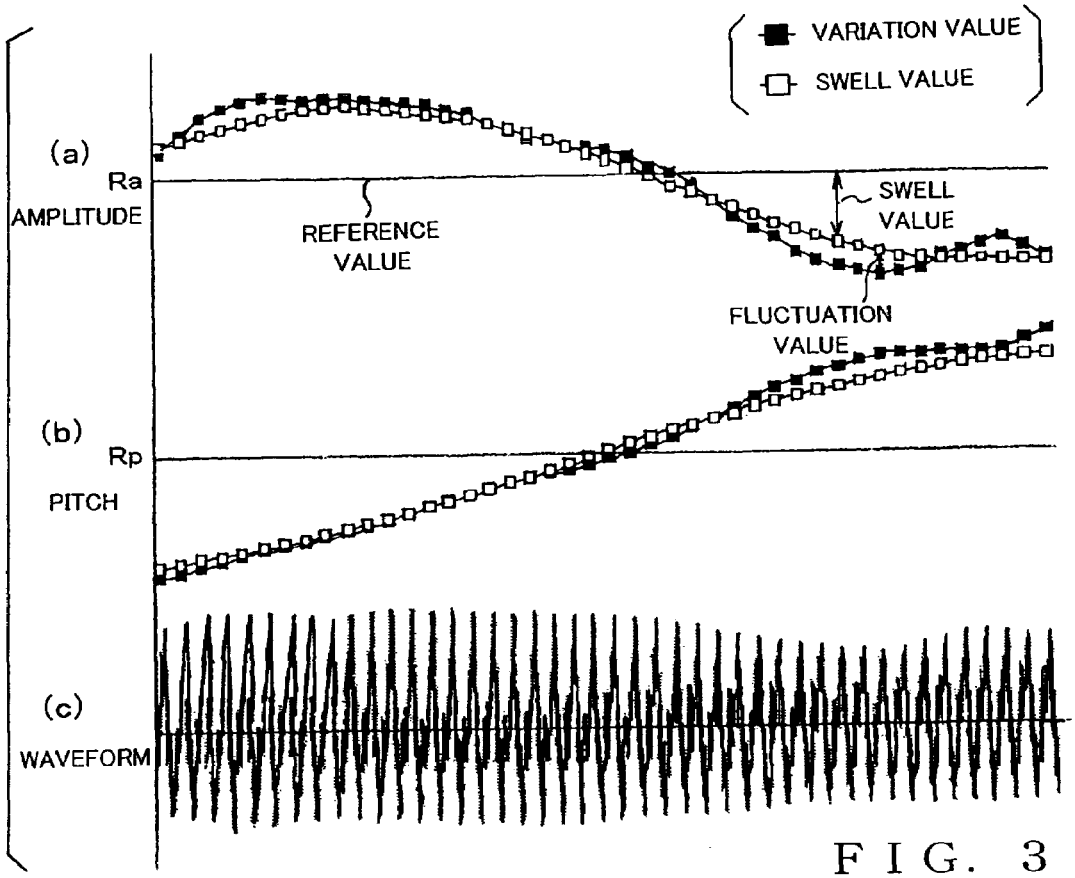
FIG. 3 is a waveform diagram showing an example of analysis of waveform data in the embodiment.

Namely, step S11 is directed to acquiring original waveform data to be analyzed. More specifically, live-performed tones are each picked up by a microphone 12 of FIG. 1, converted into digital waveform data (PCM waveform data) via the A/D converter 10 and then stored, via the waveform input interface 9 and computer bus 11, into a suitable memory (e.g., RAM 3 or hard disk 6) within the computer. Section (c) of FIG. 3 shows an example of original waveform data to be analyzed.

At next step S12, the original waveform data are time-serially divided into a plurality of segments, and, for each of the divided segments, a representative value is determined for at least particular one of various types of tone elements, such as an amplitude and pitch. Then, for each of the divided segments, a deviation, from a predetermined reference value, of the thus-determined representative value is determined as a variation value, to thereby generate a train of discrete variation values that comprises a time series of the variation values of the individual segments for the particular tone element. Let it be assumed here that trains of variation values for the pitch and amplitude are generated at step S12. As an example, the waveform represented by the original waveform data may be determined per cycle using a conventionally-known waveform cycle analysis/determination technique, in which case the determined partial waveform of each cycle (i.e., each one-cycle waveform) is set as a segment, an average value of effective values (power values) of individual sample amplitudes within the one-cycle waveform (one segment) is calculated and the thus-calculated average amplitude value is set as a representative value of the amplitude for the segment. Further, the inverse number of the time length of the one-cycle waveform (i.e., one segment) may be calculated as a frequency (i.e., tone pitch), and the thus-calculated frequency may be set as a representative value of the pitch for the segment. As an alternative, the determined partial waveform of a predetermined plurality of cycles may be set as a segment, in which case an average value of effective values (power values) of individual sample amplitudes within the plural-cycle waveform (one segment) may be calculated, and the thus-calculated average amplitude value may be set as a representative value of the amplitude for the segment. Further, in this case, the inverse number of the time length of the plural-cycle waveform (i.e., one segment) may be calculated as a frequency (i.e., tone pitch), and the thus-calculated frequency may be set as a representative value of the pitch for the segment. Note that the reference value may be set at a substantial mean value of the representative values of predetermined segments (e.g., average value of a plurality of the segments). To derive a deviation of each of the representative values of the segments as a variation value, there may be employed a scheme for calculating, as the variation value, a difference of the representative value of the segment from the reference value Ra or Rb, or a scheme for calculating, as the variation value, a ratio of the representative value of the segment to the reference value Ra or Rb. As an alternative, the representative value of each of the segments itself may be used as the variation value.

The trains of variation values for the pitch and amplitude generated in the above-described manner are temporarily stored into a suitable memory (e.g., RAM 3 or hard disk 6) within the computer. Black dots in section (a) of FIG. 3 represent an example of the train of variation values for the amplitude generated on the basis of the original waveform data of section (c) of FIG. 3, and black dots in section (b) of FIG. 3 represent an example of the train of variation values for the pitch generated on the basis of the original waveform data. Lines Ra and Rp in sections (a) and (b) of FIG. 3 represent an amplitude reference value and pitch reference value, respectively. Each of the variation values may be expressed by a relative value to the amplitude reference value or pitch reference value Ra or Rb. Note that the amplitude reference value or pitch reference value Ra or Rb may be either a constant value or a value varied as desired. Because the "swell" and "fluctuation", with which the present invention is primarily concerned, are characteristics occurring in a section where a tone lasts relatively stably, it generally suffices to perform the above-described analysis on each sustain sound portion of the original waveform data. Note that each segment to be analyzed need not be synchronized with one or a plurality of waveform cycles and may be a frame section of a suitable fixed or variable time length.

As a modification of first step S1 described above, original waveform data may be externally acquired via the communication interface 8 or acquired from a removable storage medium 13 via the memory interface 7, rather than being acquired by being picked up via the microphone 12 connected to the computer. As another modification, data indicative of trains of variation values for the pitch and amplitude, previously created using a not-shown waveform analysis device, computer or the like, may be externally acquired via the communication interface 8 or acquired from the removable storage medium 13 via the memory interface 7.

Next, at second step S2, each of the variation value trains is separated into at least one time-serial component value train in accordance with a time constant factor (or time-constant-like factor). In the instant embodiment, a train of "swell" values, corresponding to a variation component of a relatively great time constant (namely, variation component intended by or controllable by the human player), is generated as a first component value train, and a train of "fluctuation" values, corresponding to a variation component of a relatively small time constant (namely, variation component not intended by or non-controllable by the human player) is generated as a second component value train.

More specifically, at step S21, each of the trains of variation values is subjected to a smoothing process to extract therefrom a variation component of a relatively great time constant, and this variation component is generated as a train of "swell" values (first component value train). Stated differently, extracting a variation component of a relatively great time constant as mentioned above is extracting a smooth variation component by preventing the component from following small variations in the variation train. Specifically, the smoothing process may be performed by performing any suitable method, e.g. by performing low-pass filter calculations, moving median method, any of various moving average methods (simple moving average method, weighted moving average method, exponential smoothing method, etc.), move mode method, method using a Gaussian filter, or method in which a smoothing plot is manually drawn by tracing, with a finger, an image of a train of variation values visually displayed or printed out. A plurality of the methods, rather than just one, may be used in combination. The thus-generated trains of "swell" values (first component value trains) for the pitch and amplitude are stored into a suitable memory (e.g., RAM 3 or hard disk 6). White dots in section (a) of FIG. 3 represent an example of the train of "swell" values (first component value train) obtained by smoothing the amplitude variation value train represented by the black dots in section (a) of FIG. 3, and white dots in section (b) of FIG. 3 represent an example of the train of "swell" values (first component value train) obtained by smoothing the pitch variation value train represented by the black dots in section (b) of FIG. 3.

At step S22 of FIG. 2, differences between the trains of variation values for the pitch and amplitude acquired at first step S1 above and the corresponding trains of "swell" values (i.e., first component value trains) for the pitch and amplitude acquired at first step S21 above are calculated for each of the segments, and each of the resultant trains of the differences is generated as a train of "fluctuation" values (i.e., second component value train) that corresponds to a variation component of a relatively small time constant. The thus-generated trains of "fluctuation" values (i.e., second component value trains) for the pitch and amplitude are stored into a suitable memory (e.g., RAM 3 or hard disk 6). Difference value between the white and black dots for each of the segments in section (a) of FIG. 3 indicates a "fluctuation" value for the amplitude, and a difference value between the white and black dots for each of the segments in section (b) of FIG. 3 indicates a "fluctuation" value for the pitch.

Note that the train of "fluctuation" values (i.e., second component value train) that correspond to a variation component of a relatively small time constant may be generated by any other suitable scheme than the above-described difference calculation scheme, such as calculations of ratios, deviations or the like.

Although it is only necessary that the train of variation values (variation value train) be separated, at second step S2 above, into at least two component value trains corresponding to "swell" and "fluctuation", one or more other suitable component value trains may be separated from the variation value train, to carry out the present invention. Needless to say, only one of the "swell" and "fluctuation" component value trains may be generated and stored into the memory.

As conventionally known in the art, sampled waveform data includes three major tone elements, i.e. waveform (tone color element waveform), amplitude and pitch, and these tone elements can be stored separately as individual analyzing data. In tone reproduction, a tone having the three tone elements, waveform (tone color element waveform), amplitude and pitch, integrally incorporated therein is synthesized. In this case, each variation value in amplitude and pitch variation value trains of the analyzing data is expressed as a relative value to the corresponding reference value Ra or Rp of the tone color element waveform in the analyzing data. In tone synthesis, the amplitude reference value Ra can be variably set in accordance with tone volume control data, such as velocity data, and amplitude time-variation control corresponding to the amplitude variation value train is performed on the variably-set amplitude reference value Ra. Further, the pitch reference value Rp can be variably set in accordance with tone pitch designating data, such as data designating a pitch of a tone to be generated, and pitch time-variation control corresponding to the pitch variation value train is performed on the variably-set pitch reference value Ra.

[Tone Synthesis Processing=Control of "Swell" and "Fluctuation"]

Next, a description will be made about an embodiment of tone synthesis processing where a tone is synthesized using the "swell" value train (i.e., first component value train) and "fluctuation" value train (i.e., second component value train), corresponding to the tone elements (i.e., amplitude and pitch), generated in the above-described manner. This tone synthesis processing may be carried out either in real time in response to a performance on a performance operation means, such as a keyboard or execution of an automatic performance, or in non-real time on the basis of performance data prepared in advance.

Figure 4:
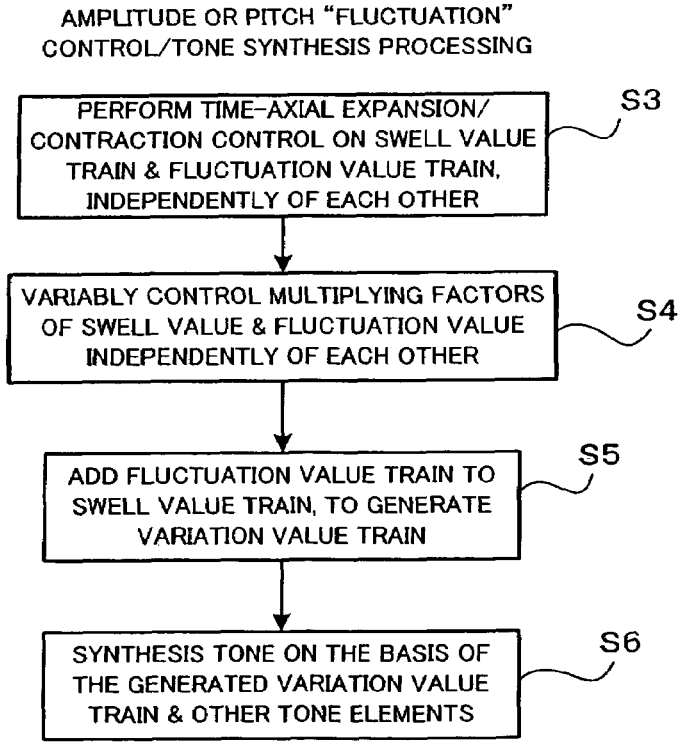
FIG. 4 is a flow chart showing an example of a swell and fluctuation control/tone synthesis program.

To execute the tone synthesis processing, the computer constructed in the manner of FIG. 1, for example, is used as hardware, and a swell and fluctuation control/tone synthesis program as shown in FIG. 4 is installed into the computer and executed by the CPU 1. For these purposes, a database of tone synthesizing data, including a data structure that comprises "swell" value trains (first component value trains) and "fluctuation" value trains (second component value trains), corresponding to the tone elements (i.e., amplitude and pitch), generated in the above-described manner for various types of tones and/rendition styles is built in a suitable memory (e.g., RAM 3 or hard disk 6). Each of sets of waveform data corresponding to various types of tones and/rendition styles includes, for one tone and/rendition style, time-serial data (analyzing data or tone synthesizing data) corresponding to at least three tone elements, i.e. waveform (tone color element waveform), amplitude and pitch, as set forth above. Here, as stated above, the time-serial data (analyzing data or tone synthesizing data) corresponding to the amplitude and pitch include a "swell" value train (first component value train) and "fluctuation" value train (second component value train) for the amplitude and pitch. Further, whereas the time-serial data for the waveform (tone color element waveform) may comprise waveform sample data that represent a waveform (tone color element waveform) of each segment in a suitable data format, such as a PCM or DPCM data format, there may be stored one representative waveform sample data for a plurality of segments in order to compress the quantity of waveform sample data to be stored. In such a case, a time-varying high-quality waveform (tone color element waveform) can be reproduced by repetitive readout of the representative waveform ample data or by a waveform interpolation process at the time of reproduction. Note that the computer of FIG. 1 is equipped with hardware and software resources, such as a tone synthesis section 14, speaker 15, etc., in order to perform tone waveform synthesis or generation. As known in the art, the tone synthesis section 14 may be in the form of either a hardware tone generator device or a software tone generator.

Once a tone color or rendition style, pitch, etc. of a tone to be generated is designated in real time at predetermined tone generation timing in response to a performance on the performance operation means, such as the keyboard, or execution of an automatic performance, or in non-real time ahead of the predetermined tone generation timing, the tone synthesis processing is initiated for the tone to be generated. Typically, when a single tone is to be generated, a tone of an attack portion is first synthesized and then tones of a sustain portion and release or decay portion are synthesized sequentially, as known in the art; thus, it is possible to synthesize a tone waveform having the above-mentioned portions sequentially connected together. Because the swell and fluctuation control/synthesis in the instant embodiment is performed on a sustain portion of a tone, no description will be made about attack, release and other portions. When a tone of a sustain portion is to be synthesized, tone color element waveform data corresponding to a designated tone color or rendition style, "swell" value train (first component value train) and "fluctuation" value train (second component value train) for the amplitude, and "swell" value train (first component value train) and "fluctuation" value train (second component value train) for the pitch are read out in time-serial order from the above-mentioned database. At that time, amplitude and pitch variation value trains are generated in accordance with the swell and fluctuation control/tone synthesis program illustratively shown in FIG. 4, a pitch of the tone color element waveform data, read out at a time-variable pitch based on the generated pitch variation value train, and time-variable amplitude control based on the generated amplitude variation value train is performed on the waveform data. In this way, a tone waveform is synthesized on the basis of a plurality of time-variable tone elements (waveform, pitch and amplitude). The following paragraphs describe in detail the swell and fluctuation control/tone synthesis processing of FIG. 4. Note that the application of the present invention is not limited to synthesis of a tone of a sustain portion and the basic principles of the present invention are of course applicable to synthesis of tones of any other desired portions.

Figure 5:
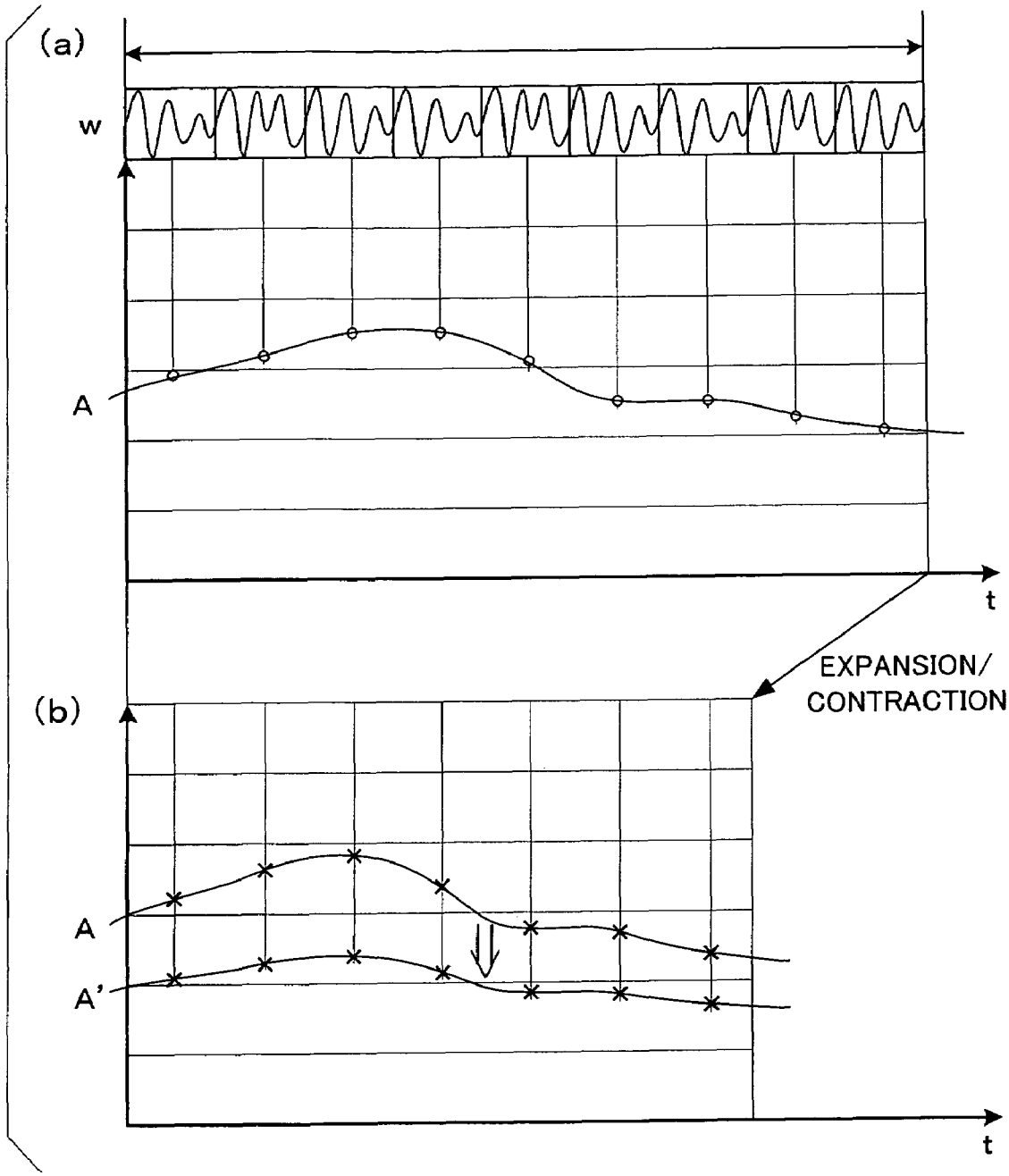
FIG. 5 is a graph schematically showing an example of time-axial expansion/contraction control of swell and fluctuation value trains based on the swell and fluctuation control/tone synthesis program of FIG. 4.

At step S3 of FIG. 4, control is performed to expand or contract the time axes of the "swell" value trains (first component value trains) and "fluctuation" value trains (second component value trains) for the amplitude and pitch, which are to be read out from the database, independently of each other, in accordance with a desired tone generating time length. In the case of non-real time synthesis or automatic performance, a tone generating time length can be identified from previously-prepared performance data and thus may be used as-is. In the case of real-time synthesis responsive to a performance by the human player, a suitable estimated tone generating time length may be used, in which case the estimated tone generating time length may be successively revised in accordance with a progression of the tone synthesis. Namely, it suffices to generate the "swell" value trains (first component value trains) and "fluctuation" value trains (second component value trains) while appropriately performing time management of synthesized waveform cycles or segments. Similar time-axial expansion/contraction control is performed on the time-serial data of the tone color element waveform to be read out from the database. FIG. 5 is a graph schematically showing an example of such time-axial expansion/contraction control. More specifically, section (a) of FIG. 5 illustratively shows time-serial data of a tone color element waveform W stored in the database, and a "swell" value train (first component value train) and a "fluctuation" value train (second component value train) for amplitude A (or pitch). Section (b) of FIG. 5 illustratively shows the time axes having been compressed. Details of the time-axial expansion/contraction control, which is performed utilizing various conventionally-known techniques, such as data interpolation synthesis, repetition (looping) and skipping (thinning-out), are known, for example, from Japanese Patent Application Laid-open Publication No. HEI-10-307586, and thus, the details will not be explained here. The time-axial expansion/contraction control can be performed on the "swell" value train (first component value train) and "fluctuation" value train (second component value train) independently of each other.

At step S4, the "swell" value trains (first component value trains) and "fluctuation" value trains (second component value trains) of the amplitude and pitch, on which the time-axial expansion/contraction control has been performed in accordance with the desired tone generating time length as discussed above, are subjected to variable adjustment/control of the values independently of each other. Each of the values may be adjusted by multiplying it by a predetermined multiplying factor (i.e., by weighting it) or by adding or subtracting a value to or from the value in question. A' in section (b) of FIG. 5 illustratively shows a changed "swell" value train (first component value train) or "fluctuation" value train (second component value train) obtained by performing weighting control on the value train with for amplitude A (or pitch) with a predetermined multiplying factor (weighting coefficient). Of course, the multiplying factor (weighting coefficient) may be appropriately varied over time instead of being kept at a constant value during the tone generation. Control data or parameters, such as the multiplying factor (weighting coefficient), may be generated in response to operation, by a human operator, of an adjusting operator, or generated from a suitable memory or data generator in response to selecting operation by a human operator or automatically in accordance with a rendition style or the like, or automatically generated during the course of execution, by the computer, of some application program.

For the train of "fluctuation" values (second component value train) corresponding to a variation component not intended by or non-controllable by the human player, it is considered preferable that the values be not greatly varied, or not varied at all, from the read-out values at step S4. However, the present invention is not limited to such control. Note that, at step S4, it is not necessary to variably control all of the component value trains; the variable control may be performed on only one of a "swell" value train (first component value train) and "fluctuation" value train (second component value train) of at least one tone element (such as the amplitude or pitch).

At step S5, an amplitude variation value train is generated by adding the amplitude "fluctuation" value train (second component value train) to the amplitude "swell" value train (first component value train) variably controlled at step S4. Similarly, a pitch variation value train is generated by adding the pitch "fluctuation" value train (second component value train) to the pitch "swell" value train variably (first component value train). The type of the arithmetic operations performed at step S5 is not limited to the addition and may be any desired one of addition, subtraction, multiplication and division depending on the designing conditions, e.g. on whether the data format of the variation value trains is linear or decibel. What is essential here is to only generate (reproduce) a variation value train for a particular tone element (e.g., amplitude or pitch), variably controlled in a separated state, by synthesizing the "swell" value train (first component value train) and "fluctuation" value train (second component value train).

At step S6, pitch setting information, which varies in a time-serial manner, is generated by adding the pitch variation value train, having been variably controlled and generated in the above-described manner, to the pitch reference value Rp for variably setting a reference pitch of the tone to be generated (or by performing multiplicative or other arithmetic operations, determined in accordance with the designing conditions, between the variably-controlled pitch variation value train and the pitch reference value Rp), so as to read out tone color element waveform data corresponding to the tone color or rendition style of the tone to be generated are read out. Also, tone-volume amplitude setting information, which varies in a time-serial manner, is generated by adding the amplitude variation value train, having been variably controlled and generated in the above-described manner, to the amplitude reference value Ra for variably setting a reference tone-volume amplitude of the tone to be generated (or by performing multiplicative or other arithmetic operations, determined in accordance with the designing conditions, between the variably-controlled amplitude variation value train and the amplitude reference value Ra), so as to set tone volume amplitudes of the waveform data to be read out in accordance with the above-mentioned desired pitch. In this manner, tone waveform synthesis is carried out on the basis of a plurality of time-variably controlled tone elements (waveform, pitch, amplitude, etc.). Because, in performing the tone waveform synthesis, it is possible to variably control the "swell" value train (first component value train) and "fluctuation" value train (second component value train) independently of each other, high-quality control can be achieved with utmost ease. Whereas the description has so far been made about the case where both of the "swell" value train (first component value train) and "fluctuation" value train (second component value train) are used in the tone synthesis, the present invention is not so limited, and only one of the component value trains may be used in the tone synthesis.

Figure 6:
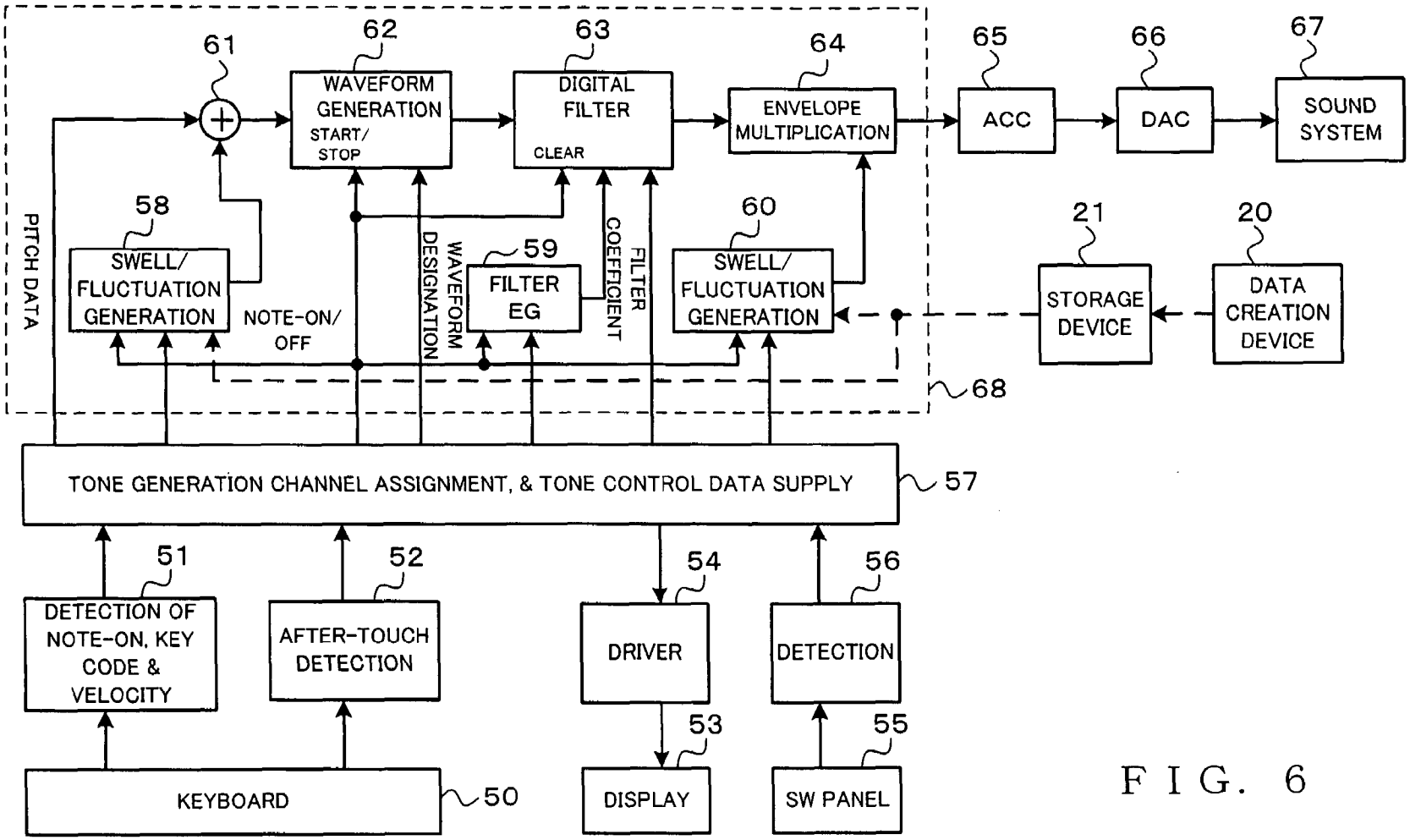
FIG. 6 is a block diagram showing an example general setup of an electronic musical instrument equipped with a tone synthesis processing function according to an embodiment of the present invention.

The apparatus employed to carry out the present invention may be any equipment dedicated to a music performance or tone synthesis, such as an electronic musical instrument or automatic performance sequencer, without being limited to a general-purpose computer, such as a personal computer. FIG. 6 is a block diagram showing an example general setup of an electronic musical instrument equipped with the tone synthesis processing function according to the present invention. The electronic musical instrument includes a storage device 21 as a tone database, in which are stored tone synthesizing data created by a data creation device 20 external to or belonging to the electronic musical instrument. Namely, the data creation device 20 performs the inventive tone data creation processing described above with reference to FIGS. 1 and 2, so that tone synthesizing data of the data structure comprising "swell" value trains (first component value trains) and "fluctuation" value trains (second component value trains), corresponding to the various tone elements (i.e., amplitude and pitch), generated in the above-described manner for various types of tones and/or rendition styles are stored in the storage device 21 as the database.

In FIG. 6, a keyboard circuit 50 includes a plurality of performing keys. Detection circuit 51 detects a note-on signal indicative of depression of any one of the keys in the keyboard circuit 50, a note-off signal indicative of release of any one of the keys, a key code signal indicative of tone pitch information or a velocity signal indicative of a key depressing velocity, and the detection circuit 51 supplies each of the detected signals to a tone control data supply circuit 57. Detection circuit 52 detects an after-touch signal indicative of a key depressing force in the keyboard circuit 50.

Switch panel 55 includes switches manually operable to give instructions for making tone volume adjustment, tone color selection, impartment of any of various effects, modulation, etc., and operators operable to variably adjust/control any of various tone elements. Switch detection circuit 56 detects operational states of the switches and operators on the switch panel 55 and output these detected operational states to the tone control data control circuit 57. Any desired tone color or rendition style can be selected via tone color selecting switches or rendition style selection switches of the switch panel 55. Once a desired tone color or rendition style is selected, the tone control data control circuit 57 supplies control data, corresponding to the tone color or rendition style selection, to a waveform generation circuit 62, digital filter 63, pitch swell/fluctuation generation circuit 58, filter coefficient EG 59 and amplitude swell/fluctuation generation circuit 60. Further, once an operator for variably adjusting the amplitude or pitch is operated, corresponding adjustment/control data is supplied to the pitch swell/fluctuation generation circuit 58 or amplitude swell/fluctuation generation circuit 60.

The tone control data control circuit 57 receives key events detected by the detection circuits 51 and 52 and switch operating states detected by the switch detection circuit 56, on the basis of which the tone control data control circuit 57 outputs a given signal to a driver 54. The driver 54 displays, on the display 53, a selected tone color, rendition style or the like in response to the input signal. The display 53 is, for example, in the form of a liquid crystal display (LCD)

In response to the key event detected from the keyboard circuit 50, the tone control data control circuit 57 supplies tone control data to a tone generator section 68 corresponding to a predetermined (assigned) tone generation channel. Assuming that there are provided a total of 16 time-divisional tone generation channels and tone generator section 68 in corresponding relation thereto, tone control data is supplied to one of the 16 tone generator sections 68 corresponding to a predetermined tone generation channel. Namely, individual components of the tone generator sections 68 operate on a 16-channel time divisional basis to time-divisionally generate 16 independent tones and outputs the generated tones to an accumulator 65.

In accordance with the tone color or rendition style selection data and pitch data supplied from the tone control data control circuit 57, the pitch swell/fluctuation generation circuit 58 acquires, from the storage device 21, a "swell" value train (first component value train) and "fluctuation" value train (second component value train) of the pitch for the selected tone color or rendition style, and then it performs operations, similar to those explained above in relation to steps S3-S5 of FIG. 4, so as to generate a pitch variation value train for the selected tone color or rendition style. The thus-generated pitch variation value train is supplied to an adder 61. In the meantime, the tone control data control circuit 57 supplies pitch data, corresponding to the key code signal of the performed key detected by the detection circuit 51, to the adder 61. This pitch data corresponds to the above-mentioned pitch reference value Rp. Thus, the adder 61 adds the pitch variation value train, variably controlled and generated in the above-described manner, to the pitch reference value Rp representative of the reference pitch of the tone to be generated, to thereby generate pitch setting information that varies time-serially and supplies the thus-generated pitch setting information to the waveform generation circuit 62. Assuming that the pitch data (pitch reference value Rp) is expressed in cents representative of a logarithm of a frequency, a logarithm signal of a tone pitch is generated by the pitch data being added with the pitch variation value train. Because the logarithm of the frequency becomes linear to the auditory sense, modulation based on addition between pitch data and a coefficient is advantageous to achievement of natural pitch modulation. However, the present invention is not so limited, and the pitch data (pitch reference value Rp) may be in linear representation. In another alternative, there may be further provided a circuit for, for example, generating an envelope simulative of an attack pitch swing and frequency swing during a rise of a tone, so as to generate a waveform with an attack pitch modulation effect during the rise of the tone; details of the circuit will note be given here.

Start and end of waveform generation by the waveform generation circuit 62 are controlled in accordance with note-on and note-off signals. The waveform generation circuit 62 generates a waveform of a shape corresponding to a waveform designating signal supplied from the tone control data control circuit 57, and it supplies the thus-generated waveform to a digital filter 63. Namely, in accordance with the tone color or rendition style selection data given from the tone control data control circuit 57, the waveform generation circuit 62 acquires, from the storage device 21, tone color element waveforms for the selected tone color or rendition style. Then, the waveform generation circuit 62 reads out and generates the tone color element waveforms at a pitch corresponding to the pitch setting information given from the adder 61, but also performs interpolation synthesis etc. while interpolating between the time-varying tone color element waveforms. The waveform generation circuit 62 may employ any desired tone generation method other than the above-described waveform memory tone generation method, such as the FM, AM, harmonics synthesis or physical model tone generation method. Namely, irrespective of which of the tone generation methods is employed, it is possible to enjoy the merits of the present invention in which control is performed on a "swell" value train and "fluctuation" value train separated from a train of variation vales of at least one of various tone element, such as the pitch and amplitude.

The digital filter 63 performs tone color control by, for example, varying a cutoff frequency in accordance with control data, such as a filter coefficient, supplied from the tone control data supply circuit 57 and filter coefficient EG 59. For example, for a rise phase of a tone, the cutoff frequency may be raised to provide a brilliant tone color and then lowered over time to provide a quiet tone color.

Each signal output from the digital filter 63 is supplied to an envelope multiplication circuit 64, where the supplied signal is multiplied by an amplitude controlling envelope waveform for a sustain portion generated by the amplitude swell/fluctuation generation circuit 60, to control the tone volume amplitude of a tone waveform to be generated. The amplitude swell/fluctuation generation circuit 60 generates not only amplitude swell/fluctuation values but also tone-volume amplitude controlling envelope waveforms for attack and release portions, details of which are however omitted here. In accordance with the tone color or rendition style selection data given from the tone control data supply circuit 57, the amplitude swell/fluctuation generation circuit 60 acquires, from the storage device 21, a "swell" value train (first component value train) and a "fluctuation" value train (second component value train) in accordance with the intensity of each note to be sounded for the selected tone color and rendition style. Then, the amplitude swell/fluctuation generation circuit 60 performs operations, similar to those of steps S3-S5 of FIG. 4, on the acquired value trains, to thereby generate an amplitude variation value train for the selected tone color or rendition styles. By adding or multiplying the thus-generated amplitude variation value train with the amplitude reference value Ra, the circuit 60 generates an amplitude envelope waveform for a sustain portion and supplies the thus-generated envelope waveform to the envelope multiplication circuit 64.

Each tone signal output from the envelope multiplication circuit 64 becomes an output signal from the tone generator section 68, so that tone signals corresponding in number to the tone generation channels are supplied to an accumulator 65 on a time-divisional basis. The accumulator 65 synthesizes the supplied tone signals of the individual tone generation channels and supplies the thus-synthesized tone signals to a D/A converter 66. The tone signals supplied to the D/A converter 66 are each converted from the digital representation to the analog representation, so that the converted tone signal is sounded or audibly reproduced via the sound system 67.

During a performance, control data or parameters for the circuits 58-60 can be manually entered in real time via the switch panel 55. Further, in an edit mode, control data or parameters for the circuits 58-60 can be variably set/adjusted through operation of parameter switches and other operators of the switch panel 55 in non-real time relative to tone generation. As the selecting, controlling and adjusting operation means, there may be employed other suitable operation means than the switch panel 55, such as a mouse, numeric key pad, alphanumeric keyboard, performing or operating touch pad.

What is claimed is:

1. A tone synthesis method for synthesizing a tone using a storage section storing a first component value train and a second component value train of a tone pitch or tone amplitude of original waveform data that are obtained from a variation value train of the tone pitch or tone amplitude of the original waveform data, the first component value train being obtained by smoothing of said variation value train of the one of the tone pitch and tone amplitude of the original waveform data, the second component value train being obtained on the basis of a difference between said variation value train and said first component value train, said tone synthesis method comprising:

a first step of performing, in accordance with a desired tone generating time length, expansion or contraction control on a time axis of at least one of said first and second component value trains read out from said storage section, to thereby obtain the component value train having a time length corresponding to the desired tone generating time length;

a second step of variably controlling a train of values of at least one of said first and second component value trains read out from said storage section or having the time axis subjected to the expansion or contraction control by said first step;

a third step of generating the variation value train of one of the tone pitch and tone amplitude on the basis of an arithmetic operation between said first and said second component value trains read out from said storage section or controlled by said first step or said second step; and a fourth step of generating a tone for the tone generating time length, using the variation value train.

2. A tone synthesis method as claimed in claim 1 wherein said first step performs one of expansion and contraction control on respective time axes of the at least first and second component value trains independently of each other, and said second step variably controls respective values of the at least first and second component value trains independently of each other.

3. A tone synthesis method as claimed in claim 1 wherein said first component value train corresponds to a swell variation component in the variation value train, and said second component value train corresponds to a fluctuation variation component in the variation value train.

4. A computer-readable medium storing a computer program for causing a computer to perform a tone synthesis procedure for synthesizing a tone using a storage section storing a first component value train and a second component value train of a tone pitch or tone amplitude of original waveform data that are obtained from a variation value train of on the tone pitch or tone amplitude of the original waveform data, the first component value train being obtained by smoothing of said variation value train of the tone pitch or tone amplitude of the original waveform data, the second component value train being obtained on the basis of a difference between said variation value train and the first component value train, said tone synthesis procedure comprising:

a first step of performing, in accordance with a desired tone generating time length, expansion or contraction control on a time axis of at least one of said first and second component value trains read out from said storage section, to thereby obtain the component value train having a time length corresponding to the desired tone generating time length;

a second step of variably controlling a train of values of at least one of said first and second component value trains read out from said storage section or having the time axis subjected to the expansion or contraction control by said first step;

a third step of generating a variation value train of the one of the tone pitch and tone amplitude on the basis of an arithmetic operation between said first and second component value trains read out from said storage section or controlled by said first step or said second step; and a fourth step of generating a tone for the tone generating time length, using the variation value train.

5. A tone synthesis apparatus for synthesizing a tone using a storage section storing a first component value train and a second component value train of a tone pitch or tone amplitude of original waveform data that are obtained from a variation value train of on the tone pitch or tone amplitude of the original waveform data, the first component value train being obtained by smoothing of said variation value train of the tone pitch or tone amplitude of the original waveform data, the second component value train being obtained on the basis of a difference between said variation value train and said first component value train, said tone synthesis apparatus comprising:

a first section that performs, in accordance with a desired tone generating time length, expansion or contraction control on a time axis of at least one of said first and second component value trains read out from said storage section, to thereby obtain the component value train having a time length corresponding to the desired tone generating time length;

a second section that variably controls a train of values of at least one of said first and second component value trains read out from said storage section or having the time axis subjected to the expansion or contraction control by said first section;

a third section that generates a variation value train of the one of the tone pitch and tone amplitude on the basis of an arithmetic operation between said first and second component value trains read out from said storage section or controlled by said first section or said second section; and a fourth section that generates a tone for the tone generating time length, using the variation value train.

* * * * *